US005412181A

United States Patent [19]

Giamati

[11] Patent Number: 5,412,181

[45] Date of Patent: May 2, 1995

[54] VARIABLE POWER DENSITY HEATING USING STRANDED RESISTANCE WIRE

[75] Inventor: Michael J. Giamati, Akron, Ohio

[73] Assignee: The B. F. Goodrich Company, Akron, Ohio

[21] Appl. No.: 173,600

[22] Filed: Dec. 27, 1993

[51] Int. Cl.[6] ..... H05B 3/34

[52] U.S. Cl. ..... 219/548; 219/212

[58] Field of Search ..... 219/212, 528, 529, 548, 219/549, 211; 338/210, 212, 214, 208, 217, 218

[56] References Cited

U.S. PATENT DOCUMENTS

| | | | |
|---|---|---|---|
| 2,499,961 | 3/1950 | Lennox | 338/218 |
| 2,973,425 | 2/1961 | Kelemen | 219/549 |
| 3,472,289 | 10/1969 | Webber et al. | 219/549 |
| 3,646,322 | 2/1972 | Speekman | 219/549 |
| 5,073,688 | 12/1991 | McCormack | 219/212 |

FOREIGN PATENT DOCUMENTS

| | | | |
|---|---|---|---|
| 3334434 | 4/1985 | Germany | 219/212 |

*Primary Examiner*—Geoffrey S. Evans
*Attorney, Agent, or Firm*—Richard A. Romanchik

[57] ABSTRACT

An improved electrothermal apparatus includes a stranded heater wire having a plurality of strands, the number of which vary as a function of position to provide a varying output power density. The stranded heater wire is disposed within a blanket which is conformable to the item to be heated. The heater wire is broken into a number of zones, with each zone having a varying number of strands. The strands of the wire are soldered or crimped together at the beginning of each zone. A controller provides electrical energy to the heater assembly.

16 Claims, 2 Drawing Sheets

VARIABLE POWER DENSITY HEATING USING STRANDED RESISTANCE WIRE

FIELD OF THE INVENTION

The present invention relates to an electrothermal deicers, and more particularly to an improved electrothermal deicer having a variable power density heating element.

BACKGROUND ART

The accumulation of ice on aircraft wings and other structural members in flight is a danger that is well known. As used herein, the term "structural members" is intended to refer to any aircraft surface susceptible to icing during flight, including wings, stabilizers, engine inlets, rotors, and so forth. Attempts have been made since the earliest days of flight to overcome the problem of ice accumulation.

One approach that has been used is thermal deicing. In thermal deicing, the leading edges, that is, the portions of the aircraft that meet and break the airstream impinging on the aircraft, are heated to prevent formation of ice thereon, or to loosen already accumulated ice. The loosened ice is thereby blown from the structural members by the airstream passing over the aircraft.

In one form of thermal deicing (herein referred to as electrothermal deicing), heating is accomplished by placing electrothermal pads which include heating elements over the leading edges of the aircraft, or by incorporating the heating elements into the structural members of the aircraft. Electrical energy for each heating element is derived from a generating source driven by one or more of the aircraft engines. The electrical energy is intermittently or continuously supplied to provide heat sufficient to prevent the formation of ice or to loosen accumulating ice.

Typical configurations for electrothermal deicing heating units include a wire wound, braided, or etched foil element which is arranged in a serpentine fashion. The amount of power dissipation per unit area for the deicer is regulated by varying the density of the wire within a given area by changing the spacing of the wire. This, however, is not always desirable, especially when the power density profile is changing. A decreasing power density profile requires increased wire spacing which in effect distributes the power output from the wire over a larger area. Increased wire spacing is undesirable because it results in "cold spots" between the wires do to limitations with 2-D heat transfer. Ice typically will not melt in these cold spots effectively.

Efforts to improve such variable power density electrothermal deicing systems have led to continuing developments to improve their versatility, practicality and efficiency.

DISCLOSURE OF THE INVENTION

According to an aspect of the present invention there is provided a thermal deicing apparatus for an airfoil comprising a heater wire comprised of at least one conductive strand, the heater wire being arranged in a predetermined pattern, and wherein the number of strands varies as a function of the position of the heater wire in the pattern.

According to another aspect of the invention, there is provided a method of deicing an airfoil comprising the steps of arranging a heater wire into a predetermined pattern, the wire having a plurality of conductive strands and, varying the number of strands as a function of the position of the wire in the pattern.

The present invention provides for improved control over the heating of different surfaces, thereby making thermal heating systems more energy efficient. The present invention eliminates the need for etching metal foil elements, is easy to manufacture, provides better installation and fit, and can be utilized with any of a number of patterns and materials.

These and other objects, features and advantages of the present invention will become more apparent in the light of the detailed description of exemplary embodiments thereof, as illustrated by the drawings.

BRIEF DESCRIPTION OF THE DRAWINGS

FIG. 1A is a cross section of a heater wire means in accordance with the present invention taken along lines 1A—1A of FIG. 1.

FIG. 1B is a cross section of a heater wire means in accordance with the present invention taken along lines 1B—1B of FIG. 1.

FIG. 1C is a cross sectional view of a heater wire means in accordance with the present invention taken along lines 1C—1C of FIG. 1.

BEST MODE FOR CARRYING OUT THE INVENTION

Figure 1:
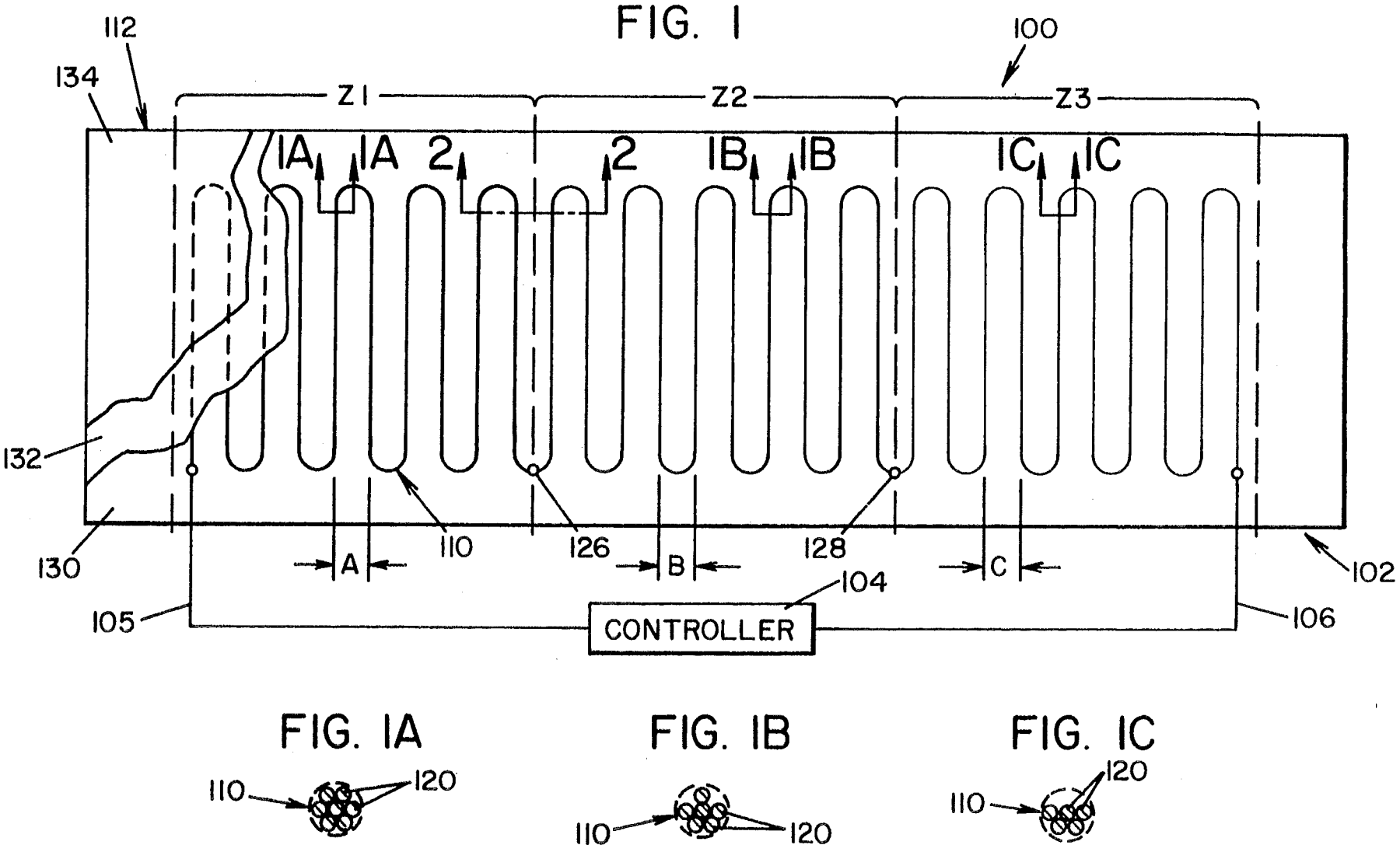
FIG. 1 is a top view, partially cut away, of a thermal ice protection apparatus in accordance with the present invention.

Referring now to FIG. 1, an electrothermal ice protection apparatus or deicing system 100 in accordance with the present invention includes a deicer assembly 102, a controller 104 for controlling deicer 102 and a pair of leadwires 105, 106 for conducting electrical energy to and from deicer 102. Deicer assembly 102 is adapted to be attached to an airfoil (not shown), and is comprised of a stranded, resistance type heater wire 110 disposed within a blanket 112 and arranged in a predetermined pattern, preferably a serpentine type configuration, with a predetermined wire spacing A,B,C. It is to be noted that any of a number of configurations may be utilized, the exact arrangement being dependent on a number of factors such as airfoil shape, location, aerodynamics, etc. Heater wire 110 is comprised of a plurality of conductive strands which are twisted together, wherein the number of strands varies as a function of position. As illustrated, heater wire 110 has three zones with the number of conductive strands in the wire differing in each zone.

Referring now to FIGS. 1A–1C, heater wire 110 has a plurality of individual conductive strands 120. The heater wire 110 in zone Z1 is illustrated in FIG. 1A as having seven strands, the heater wire in zone Z2 is illustrated in FIG. 1B as having six strands, and the heater wire 110 in zone Z3 is illustrated in FIG. 1C as having five strands. The electrical resistance of heater wire 110 decreases as the number of strands 120 increases, thereby decreasing the power output. Reducing the number of strands increases the heater wire resistance and increases the power output. Assuming heater wire spacing A,B,C is constant and equal, the heater wire 110 in zone Z3 therefore has a greater heating power output than in zone Z2, which in turn has a greater heating power output than zone Z1. It is to be noted that the number of strands utilized in the example set forth is not intended to be limiting, with the quantity of strands being dependent upon any of a number of factors such as wire conductivity, required power output, etc.

The material utilized for strands 120 may be any of number of acceptable metal alloys well known to those skilled in the electrothermal heater art, such as 34 AWG Alloy 180 available from MWS Wire Industries, Jellif, Driver-Harris, Carpenter Tech., Hoskins, or Kanthal. An example of an acceptable heater wire 110 for the present invention is catalog no. MWS-180 available from MWS Wire Industries.

Referring now to FIG. 1, the heater wire 110 in zone Z1 has a calculated number of strands (seven as illustrated in FIG. 1A) to achieve the desired power density output for an exact wire length (length 1) to wind a specific heated zone Z1 at spacing (A). The next heated zone Z2 with a different power density output requirement might require a calculated number of strands (six as illustrated in FIG. 1B) for a length to wind zone Z2 at wire spacing B. The heater wire 110 is soldered, welded or crimped together at the end of length 1 at a junction point 126, and one or more strands would be cut off just after the weld. Zone Z2 therefore has a heater wire with a resistance per unit length that is greater than that in zone Z1. The resulting power density output for zone Z2 is greater than that of zone Z1, assuming the wire spacing B is the same as wire spacing A. The power density output for zone Z3 is likewise greater than that for zones Z1 or Z2 since zone Z3 is characterized by having a wire with less strands than that of zones Z2 and Z1. The heater wires of zone Z2 are soldered, welded or crimped together at a second junction point 128. This same process can be repeated for additional zones (not shown). The number of strands can also be increased for a zone length to decrease the power density output for the same wire spacing. Individual strands can be the same or of a different wire gauge as well as different alloys. The solder, crimp joint, or weld at the end of each zone length assures that electrical contact has been made for the strands over the entire length of heater Wire 110. An alternate method to the soldering, crimping or welding is to tightly twist the conductive strands wherein the conductive path would be through the contact of the strands. Ideally, the heater wire 110 would be manufactured with a desired variable stranding per specific lengths. Heating elements could be thereby wound with pin fixtures that hold and maintain the correct location for the specific wire stranding lengths so they provide the desired power densities in the correct zones.

Figure 2:
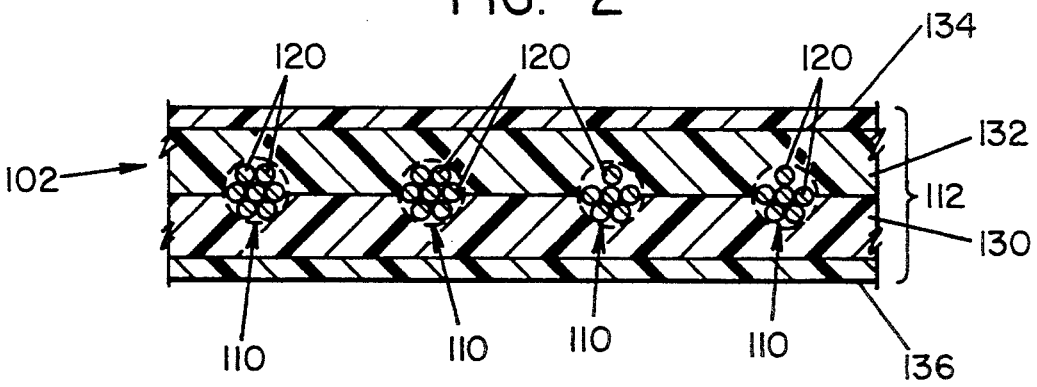
FIG. 2 is a cross sectional view of an ice protection apparatus in accordance with the present invention, taken along line 2—2 of FIG. 1.

Referring now to FIG. 2, deicer assembly 102 includes a stranded heater wire 110 which has been arranged in serpentine configuration. The left two wire cross sections shown in FIG. 2 represent the wire in zone Z1, and the right two wire cross sections represent the wire in cross section Z2. The wire 110 is disposed and encapsulated in a blanket 112 which includes an erosion layer 134, a top laminate layer 132, a bottom laminate layer 130, and a base layer 136, all of which are formed into an integral assembly. Layers 130–136 may be comprised of any of a number of materials which are well known to those skilled in the electrothermal heating art.

For example, erosion layer 134 and base layer 136 may be comprised of a chloroprene based mixture such as is provided in the list of ingredients in TABLE I.

TABLE I

| INGREDIENT RUBBER | PARTS/100 |
|---|---|
| Chloroprene | 100.00 |
| Mercaptoimidazoline | 1.00 |
| Carbon Black | 23.75 |
| Polyethylene | 4.00 |
| Stearic Acid | 0.50 |
| Pthalamide Accelerator | 0.75 |
| Zinc Oxide | 5.00 |
| Magnesium Oxide | 6.00 |
| N-Butyl Oleate | 4.00 |
| Oil | 5.00 |
| Diphenylamine Antioxidant | 4.00 |
| TOTAL | 154.00 |

An exemplary chloroprene is NEOPRENE WRT available from E. I. DuPont denemours & Company. An exemplary Mercaptoimidazoline is END 75, NA22 available from Wyrough & Loser. An exemplary carbon black is N330 available from any of a number of manufacturers, such as Cabot Corp. or Akzo Chemical Inc. An exemplary polyethylene is the low molecular weight polyethylene AC1702 available from Allied Signal. An exemplary pthalamide accelerator is HVA-2 (n,n-phenylene-bis-pthalamide) accelerator available from E. I. DuPont denemours & Company. is The stearic acid and zinc oxide utilized may be procured from any of a number of available sources well known to those skilled in the art. An exemplary magnesium oxide is available from Basic Chemical Co.. An exemplary oil is Superior 160, available from Seaboard Industries. An exemplary diphenylamine antioxidant is BLE-25 available from Uniroyal Corp.

Manufacture of the chloroprene for layers 134, 136 is as follows. The chloroprene resin is mixed on the mill, and then the ingredients listed in TABLE IV are added in their respective order. When the mix is completely cross blended, the mixture is then slabbed off and cooled.

Laminate layers 130, 132 may be comprised of any of a number of materials which can be cross-linked or formed together to encapsulate heater wire 110, such as chloroprene coated nylon fabric catalog no. NS-1003 available from Chemprene, which is a 0,004 inch thick square woven nylon fabric, RFL dipped and coated with chloroprene to a final coated fabric thickness of 0.007 inch.

Manufacture of the ice protection apparatus is as follows. First place the top chloroprene laminate layer 132 flat onto a wiring fixture. Next, apply a tie-in building cement, such as part no. A1551B, available from the B. F. Goodrich Company, Adhesive Systems business unit to the top layer 132, and apply the wire 110 to the top layer 132. Next, apply the building cement to the bottom laminate layer 130 and apply the bottom laminate layer 130 over the wire 110, being careful to remove any trapped air, and press together. Next, brush a surface cement, such as the chloroprene based cement catalog no. 021050 available from the B. F. Goodrich Company, Adhesive Systems business unit onto a build metal. Place erosion layer 134 onto the build metal and remove any trapped air. Apply build cement A1551B over the layer 134 and allow to dry. Place the element build up of layers 130, 132 with wire 110 over the cemented layer 134. Apply build cement A1551B over the element build up. Place base layer 136 over the cemented element build-up. Apply surface cement 021050 over the build-up. Cover with impression fabric and remove wrinkles. Place a bleeder over the impression fabric and remove wrinkles, bag, pull vacuum and cure in a steam autoclave at 40–60 psi, 310° F. for about 40 minutes.

It is to be noted that the preferred materials for the deicer 102 is dependent on a number of design factors, such as expected life, the substrate which is to be heated, price, thermal conductivity requirements, etc.. To this end, suitable encapsulating materials for wire 110 include silicone, epoxy resin/fiberglass composites, polyester resin/fiberglass composites, polyurethane, Kapton® film with FEP or epoxy adhesives, butyl rubber, or fabrics reinforced with phenolic resins.

It is to be noted that the wire spacing (A, B, C) and the particular number of strands 122 per zone are dependent on any number of design factors. It can be seen that varying the wire spacing and number of strands provides a great amount of flexibility in adjusting the power output of each zone to the particular design requirements.

Figure 3:
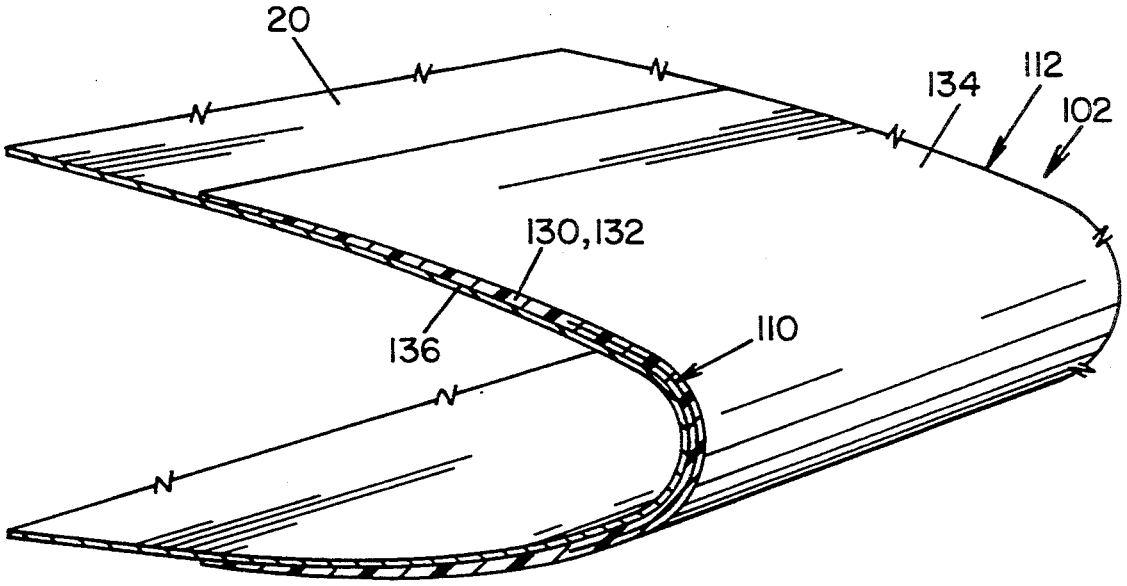
FIG. 3 is an isometric, cross sectional fragmentary view of an ice protection apparatus in accordance with the present invention mounted on an airfoil.

Referring now to FIG. 3, the ice protection apparatus 102 of the present invention is disposed on an airfoil 20 and is comprised of a wire element 110 formed within a top layer 132 and a base layer 130, with the top layer and bottom being cured together into an integral assembly so that the two layers cannot be readily discerned after curing.

It is also to be noted that the present invention directed to a electrothermal heater having heat output which varies as a function of position, and is not intended to be limited to only deicing applications. For example, the present invention may utilized in heater blankets for batteries, seats, valves, drainmasts, etc.

Although the invention has been shown and described with exemplary embodiments thereof, it should be understood by those skilled in the art that the foregoing and various other changes, omissions and additions may be made therein and thereto without departing from the spirit and the scope of the invention.

I claim:

1. An electrothermal heater comprising:

a stranded wire comprising a plurality of conductive strands, said stranded wire being arranged in a predetermined pattern, wherein the number of said plurality of strands varies as a function of position in said predetermined pattern.

2. An electrothermal heater in accordance with claim 1 further comprising a heater blanket for encapsulating said wire means.

3. An electrothermal heater in accordance with claim 2, wherein said heater blanket comprises a top layer and a bottom layer cured into a unitary matrix.

4. An electrothermal heater in accordance with claim 1, further comprising controller means for providing electrical energy to said stranded wire.

5. An electrothermal heater in accordance with claim 1, further comprising connective means for electrically connecting all of said plurality of strands in said stranded wire together where the number of said plurality of strands of said wire means changes.

6. An electrothermal heater in accordance with claim 1, wherein said predetermined pattern is a serpentine configuration.

7. An electrothermal heater in accordance with claim 1, wherein said predetermined pattern comprises a serpentine type configuration having a wire spacing which is approximately constant.

8. An electrothermal heater in accordance with claim 1, wherein said predetermined pattern comprises a serpentine type configuration having a wire spacing which varies with position.

9. A method of heating a structure comprising the steps of:

arranging a stranded wire into a predetermined pattern, said stranded wire having a plurality of conductive strands for conducting electrical energy; and, varying the number of said plurality of strands as a function of position in said predetermined pattern;

disposing said Stranded wire onto or within the structure; and, conducting current through said stranded wire.

10. A method of heating a structure in accordance with claim 9, further comprising the step of encapsulating said stranded wire in a heater blanket.

11. A method of heating a structure in accordance with claim 10, wherein said heater blanket comprises a top layer and a bottom layer cured into a unitary matrix.

12. A method of heating a structure in accordance with claim 9, further comprising the step of providing electrical energy to said stranded wire.

13. A method of heating a structure in accordance with claim 9, further comprising the step of electrically connecting all of said plurality of strands in said stranded wire together where the number of said plurality of strands of said wire changes.

14. A method of heating a structure in accordance with claim 9, wherein said arranging step comprises arranging said stranded wire in a serpentine configuration.

15. A method of heating a structure in accordance with claim 9, wherein the spacing of said stranded wire in said predetermined pattern is approximately constant.

16. A method of heating a structure in accordance with claim 9, wherein the spacing of said stranded wire in said predetermined pattern varies with position.

* * * * *